US005470140A

United States Patent [19]

Schagunn

[11] Patent Number: 5,470,140

[45] Date of Patent: Nov. 28, 1995

[54] INTERLOCKING TILE EDGE FOR COUNTERTOPS

[76] Inventor: Craig Schagunn, 12012 NE. 14th, Vancouver, Wash. 98684

[21] Appl. No.: 223,687

[22] Filed: Apr. 6, 1994

[51] Int. Cl.[6] ..... A47B 96/18

[52] U.S. Cl. ..... 312/140.3

[58] Field of Search ..... 312/140.1, 140.3; 52/783, 784, 829, 830, 262, 27.5, 716.1, 202

[56] References Cited

U.S. PATENT DOCUMENTS

| | | | |
|---|---|---|---|
| 2,717,187 | 9/1955 | Morgan et al. | 52/783 |
| 5,310,435 | 5/1994 | Kelly | 52/783 X |
| 5,348,384 | 9/1994 | Hull et al. | 312/140.3 |

FOREIGN PATENT DOCUMENTS

| | | | |
|---|---|---|---|
| 181601 | 6/1922 | United Kingdom | 52/783 |

*Primary Examiner*—Kenneth J. Dorner
*Assistant Examiner*—Robert J. Sandy
*Attorney, Agent, or Firm*—Marger, Johnson, McCollom & Stolowitz

[57] ABSTRACT

A modular countertop is used for covering a base structure. A flat sheet material formed of a first material essentially impervious to moisture penetration, impact and scratching extends substantially over the entire top surface of the base structure. A molding is joined around the edge of the base structure with the top surface of each molding recessed a given distance below the sheet material. Multiple preformed substantially "V-shaped" ceramic tiles are then placed over the top surface of the molding and butted against the edge of the base structure thereby forming a cohesive water impervious covering over the top surface and around the edges of the base structure.

16 Claims, 5 Drawing Sheets

INTERLOCKING TILE EDGE FOR COUNTERTOPS

BACKGROUND OF THE INVENTION

This invention relates generally to table and cabinet coverings and more particularly to a novel modular countertop system.

One common countertop comprises a single continuous piece of FORMICA glued to the top of a horizontal table. Elongated edges made from the same FORMICA material are then glued around the edge of the table. FORMICA is resistent to stains and chipping and provides a continuous water impervious sheet of material that is easy to clean. The single sheet of FORMICA, however, has a fairly drab aesthetic appeal since the countertop will comprise only one color. Thus, interior designers are fairly limited in color combinations and design creativity when using FORMICA.

The FORMICA edges of the countertop also require rather expensive equipment and a considerable degree of skill to install. Also, the FORMICA edges form a flat vertical edge with no lift or rise to prevent liquids that have been spilled on the countertop from overflowing the edge. Also, there is an unsightly dark line that exists between the FORMICA edge and the countertop.

U.S. Pat. No. 3,077,012 to Speraw describes a semi-spherical edge piece that is attached onto the edge of a countertop. The circular edge piece, however, is rather difficult to fabricate and includes a plastic outer layer that is difficult to attach and expensive to manufacture. The edge piece rises fairly abruptly from the top of the FORMICA surface in turn reducing the amount of useable countertop surface.

Alternatively, countertops are made from multiple ceramic tiles that are placed adjacent to each other on top of a plywood table. The spaces between adjacent tiles are then grouted to form a continuous water impervious surface. Because the countertop is made from multiple individual ceramic tiles, an almost limitless combination of colors and geometric tile configurations can be produced.

Tile countertops, however, are difficult to clean because of the multiple discontinuities in surface height between the ceramic tiles and their grouted edges. For example, dirt and stains are difficult to remove from the slight valleys that exist in the grouted areas. In addition, the grout between the tiles is subject to cracking when excessive force is applied to the top of the counter.

Accordingly, a need remains for a easy to install countertop surface that can be arranged in a variety of different color and geometric combinations while at the same time providing an easy to clean surface that is resistent to cracking.

SUMMARY OF THE INVENTION

It is, therefore, an object of the invention to increase the number of color and design variations that can be created with countertop materials.

Another object of the invention is to reduce the amount of time and skill required to install countertops. A further object of the invention is to increase the aesthetic appeal of countertops while at the same time maintaining an easy to clean surface.

A countertop surface includes a single continuous sheet of water impervious material, such as FORMICA, that is laid over the top of a cabinet, table, vanity top and the like. A novel molding is then attached to the edge of the countertop and used to support edge members. In one embodiment, the edge members comprise V-shaped ceramic tiles that wrap over the top and around the side of the molding.

The molding has a top surface that is recessed below the top surface of the sheet material a distance approximately equal to the thickness of the ceramic tiles. Thus, when the tiles are attached onto the molding, a top portion of each tile lies substantially flush with the sheet material. The edges between adjacent tiles and between each tile and the sheet material are then grouted. The tiles and the sheet material create a continuous water impervious surface over the top and around the edges of the countertop.

The ceramic tiles increase the aesthetic appeal of the countertop and allow a wider variety of color combinations to be used in conjunction with the sheet material. The size of both the molding and edge tiles are varied in conjunction so that different geometric tile configurations can be laid over the top and around the edge of the countertop. Because a substantial area of the countertop remains covered by the sheet material, the countertop surface remains easy to clean. In one configuration, the tiles slant slightly down from the outside edge of the countertop to the edge of the sheet material. The slanted tiles prevent liquids from spilling over the edge of the countertop.

The molding attached to the sides of the countertop allow the edge tiles to be attached quickly and can be prefabricated prior to installation for low-cost manufacturing. A strong bond between the molding and the edge of the countertop prevent the grout between the tiles and the sheet material from cracking. In certain embodiments, the molding also serves to support a top member of the cabinet above side walls.

The top member of the cabinet can be made from two different layers of wood materials to maintain a strong countertop surface while at the same time reducing installation and material costs. For example, a top layer of particle board is placed over a bottom layer of plywood to provide sufficient surface height so that the sheet material and the ceramic edge members lie flush. An edge member made from a harder material such as plywood is then attached around the outside of the particle board to ensure a strong bond between the molding and the countertop.

The foregoing and other objects, features and advantages of the invention will become more readily apparent from the following detailed description of a preferred embodiment of the invention which proceeds with reference to the accompanying drawings.

BRIEF DESCRIPTION OF THE DRAWINGS

FIG. 6 is partial section view of the countertop shown in

FIG. 1 with a L-shaped molding.

DETAILED DESCRIPTION

Figure 1:
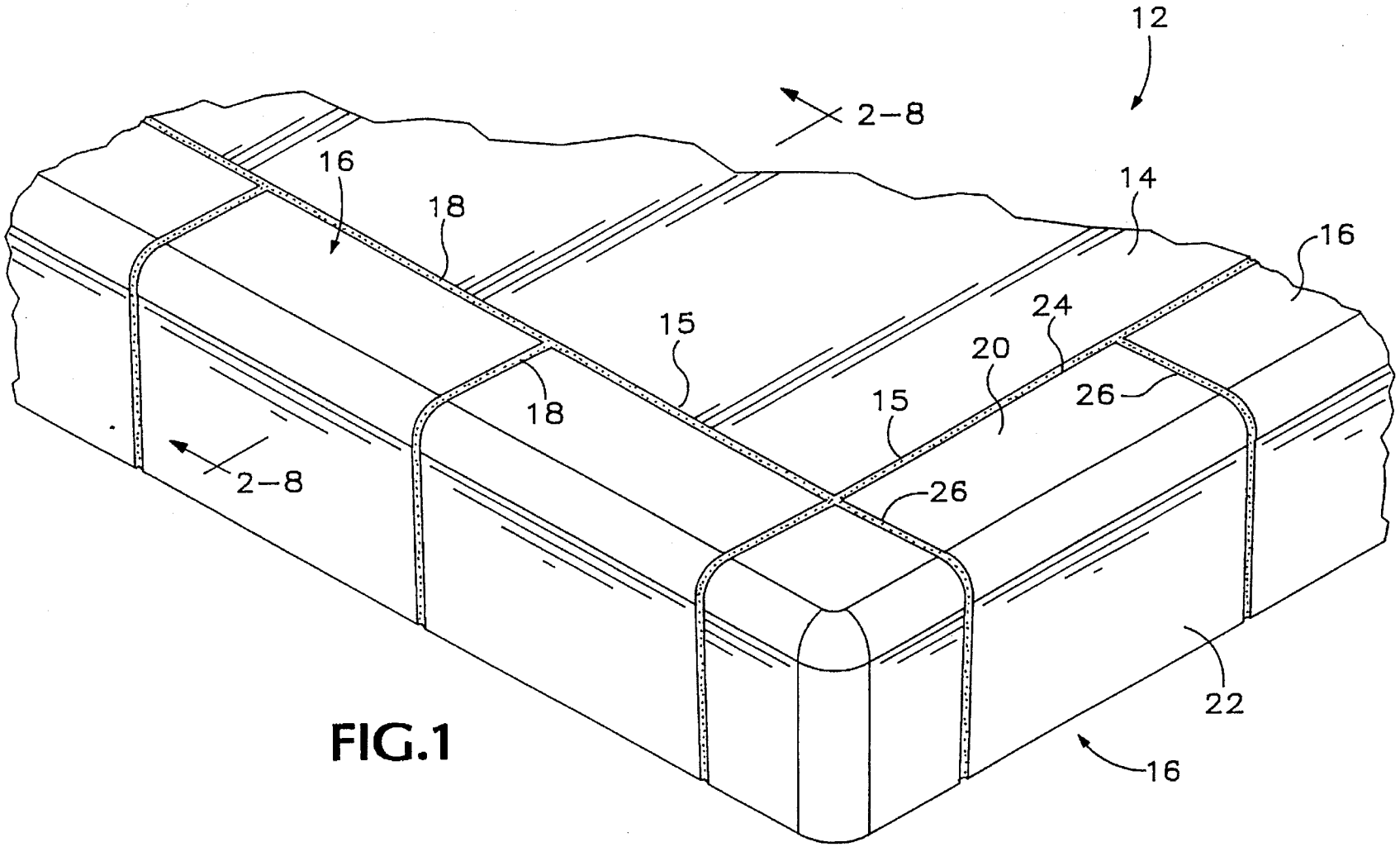
FIG. 1 is a perspective view of a countertop according to the invention.

FIG. 1 is a perspective view of a countertop 12 according to the invention. The countertop 12 is supported on a base structure (not shown) such as a cabinet, table, vanity or the like. The base structure is shown in detail in FIGS. 2–8. The countertop 12 includes a flat sheet material 14 having a front edge 15. Multiple preformed substantially "V-shaped" edge members 16 are attached along the edges of the sheet material. Each edge member 16 includes a top portion 20 having a front face 24 joined to the front edge 15 of the sheet material 14. A front portion 22 extends along the side walls of the base structure (see FIG. 6). The lateral sides 26 of adjacent edge members 16 are aligned together.

Grout is inserted between the edges of the sheet material 14 and the side and front edges of each edge member 16 forming a cohesive water impervious covering over the base structure (not shown). The sheet material 14 extends substantially over the entire top surface of the base structure and is made from a material essentially impervious to moisture penetration, impact and scratching, such as FORMICA. The edge members are typically fabricated from a V-shaped ceramic tile. Alternative materials such as plastic, wood, or metal can also be used to fabricate the edge members.

Figure 2:
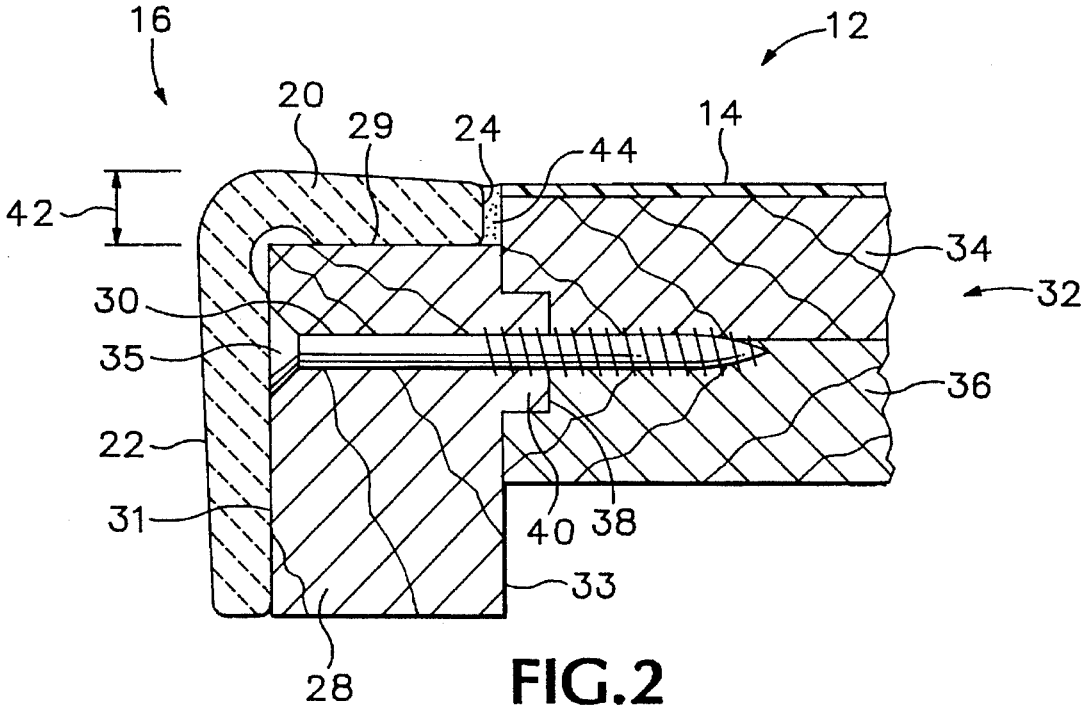
FIG 2 is a partial section view of the countertop shown in FIG. 1 including a V-shaped edge tile and a molding having an elongated side face.

FIG. 2 is a partial section view of the countertop 12 shown in FIG. 1 according to a first embodiment of the invention. The base structure includes a top member 32 that supports the sheet material 14. The top member, for example, is the top panel on a cabinet or a table top, etc. The outside edge of top member 32 is joined to a molding 28 that supports the ceramic V-shaped edge tile 16. The molding 28 is precut into sections that extend around the edges of the top member 32. The length of each molding varies according to the shape of the top member 32 and depending on the desired precut length.

Each molding 28 includes a horizontally aligned top face 29, a vertically aligned outside face 31 and an inside surface 33. The inside surface 33 includes a tongue portion 40 that is insertable into a corresponding groove 38 located along the edge of the top member 32. A tongue and groove arrangement can also be located between adjacent molding members to provide increased interlocking strength around the edge of the countertop.

The molding 28 is glued to the edge of top member 32 and further held in place by screw 30. A pre-drilled hole extends laterally through the molding 28. The screw 30 is inserted through the pre-drilled hole and then drilled into the edge of top member 32. The pre-drilled holes ensure that the screw 30 traverses in a horizontal direction through the top member 32 preventing damage to the sheet material 14.

The top face 29 of each molding is recessed below the sheet material 14 a distance substantially equal to the thickness 42 of the edge member 16. The top portion 20 of the edge member 16 can then be mounted substantially flush with the sheet material 14. Because, the top portion 20 is substantially flat, the edge member 16 extends the usable surface area of the countertop 12. This is superior over the rounded edge members previously described in Speraw which actually reduce the amount of usable table surface area.

The top portion 20 slopes slightly downward from the front portion 22 down to the front face 24. The front face 24 is substantially flush with the sheet material 14. Grout 44 is inserted between the front face 24 and the edge of top member 32. Thus, sloping top portion 22 prevents liquids spilled on the countertop 12 from running over the edge.

The top portion 20 and the top face 29 of the molding 28 are substantially the same length. The front portion 22 of each edge member 16 and the outside face 31 of the molding 28 are also substantially the same length. Thus, the tiles are automatically aligned by simply placing the tile over the molding 28. For example, by placing the tile over the molding, the front edge 24 of each tile 16 is automatically aligned parallel with the edge of top member 32.

Figure 3:
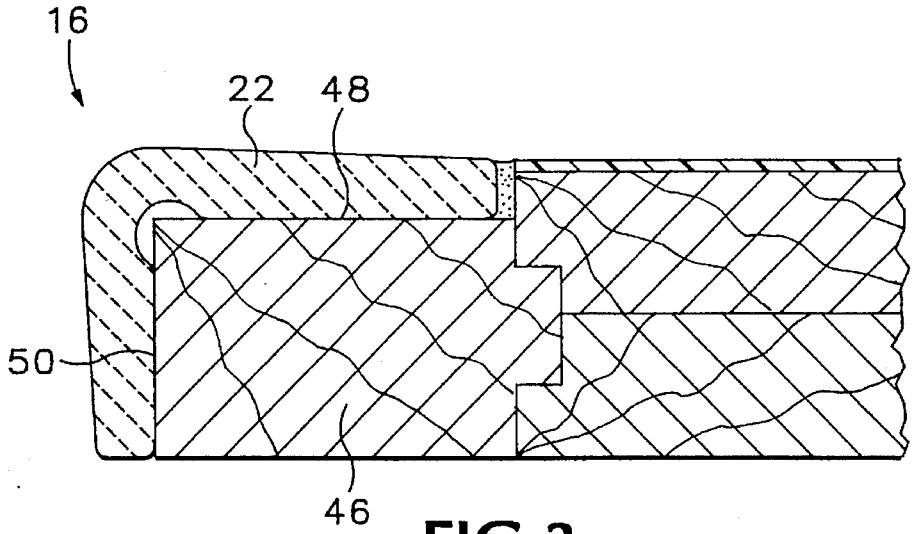
FIG. 3 is a partial section view of the countertop shown in FIG. 1 including a V-shaped edge tile and a molding having an elongated top face.

FIG. 3 is a partial section view of the countertop shown in FIG. 1 with the V-shaped ceramic tile 16 having the longer front portion 22 located on the top face 48 of molding 46. For an alternative geometric configuration, molding 46 has a top face 48 that is longer than a side face 50. Thus, the tile edge member 16 can be inverted from the position previously shown in FIG. 2 so that more tile surface is exposed on the top surface of the countertop 12.

Figure 4:
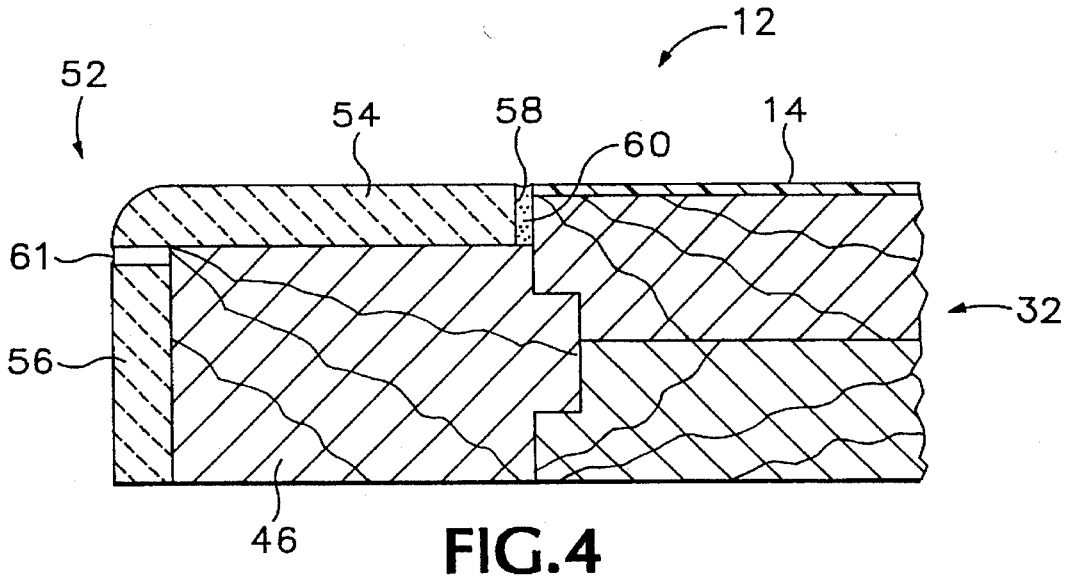
FIG. 4 is a partial section view of the countertop shown in FIG. 1 including a two piece edge tile.

FIG. 4 is a partial section view of the countertop 12 shown in FIG. 1 with an edge member 52 made from two separate tile pieces. The edge member 52 includes a flat top piece of ceramic tile 54 and a second separate flat side piece 56. Grout 60 is placed between a front edge 58 of the top piece 54 and the front edge of sheet material 14. Grout 61 is also place between the top piece 54 and the side piece 56. The two piece edge member 52 provides further design flexibility since the top piece 54 and the side piece 56 can be different colors, shapes, or can be made from different materials.

Referring back to FIG. 2, the top member 32 of the base structure comprises a bottom layer of ¾ inch plywood 36 and a top layer 34 made from a second material. The top layer 34 is typically made from either a second layer of ¾ inch plywood or from a less expensive material such as particle board. The second layer 34 of material raises the top surface of the top member 32 high enough so that the top portion 20 of edge member 16 can lie flush with the sheet material 14. Alternatively, a single 1½ inch sheet of wood can be used for the top member 32. Other word and synthetic materials would also be similarly adaptable for the top member 32.

Figure 5:
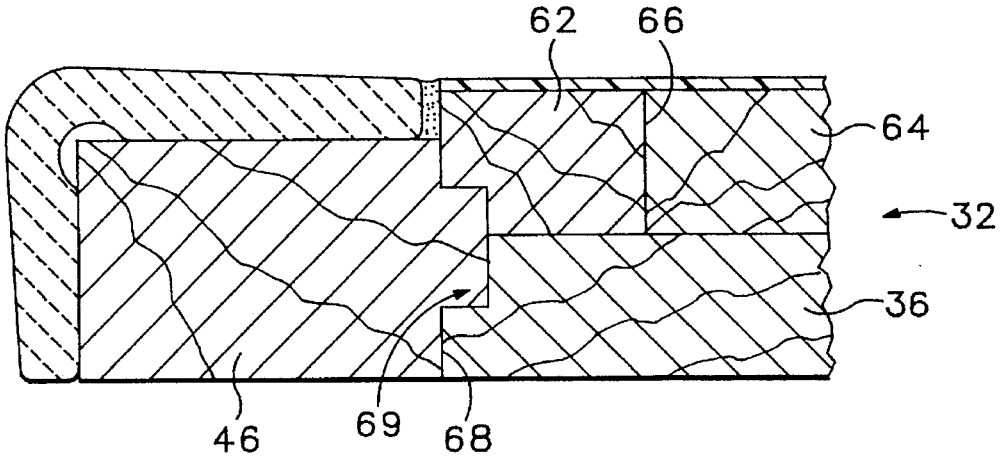
FIG. 5 is a partial section view of the countertop shown in FIG. 1 with a top member having an exterior plywood edge.

Referring to FIG. 5, when particle board is used for the top layer of the top member 32, it may be desirable to reinforce the structural bond between the molding 46 and the edge of the top member 32. For example, FIG. 5 shows a top layer 64 made from particle board. An edge 66 of top layer 64 is recessed in from the edge 68 of the bottom layer 36.

A plywood edge extension member 62 is attached to the edge 66 of the top layer 64 and extends substantially flush with the edge 68 of the bottom layer 36. The edge of the top member 32 is then routed to create groove 69. Thus, the molding member 46 is attached to a stronger plywood material at both the bottom and top layers of top member 32. Screw 30 (FIG. 2) when drilled into the top member also attaches more securely to a stronger wood material in turn making a stronger cohesive bond between the molding 46 and the top member 32.

Figure 6:
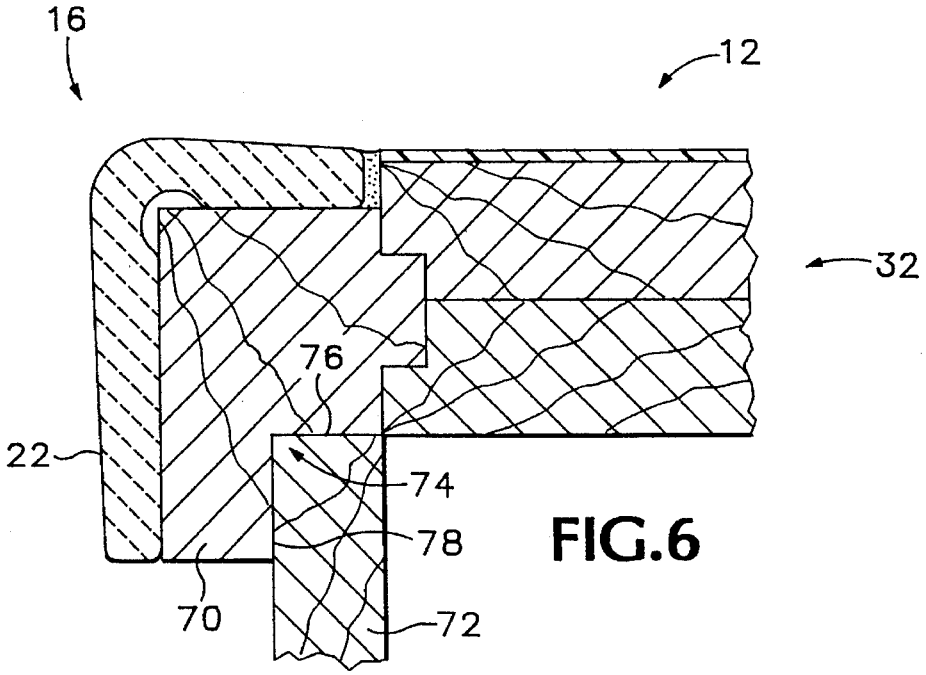

FIG. 6 is a partial section view of the countertop 12 shown in FIG. 1 with a L-shaped molding 70. A side wall 72 and the top member 32 comprise portions of a base structure used for supporting the countertop 12. For example, the base structure may be a table or cabinet. The inside surface of the molding 70 includes an L-shaped notch 74 located over a top face 76 and against an outside face 78 of side wall 72.

The molding 70 serves as a support for the edge member 16 while at the same time supporting the top member 32 above the side wall 72. The recessed top member 32 also allows the molding 70 to extend further along the top surface of the countertop 12. The front portion 22 of edge member 16 can also be aligned closer to the side wall 72.

Figure 7:
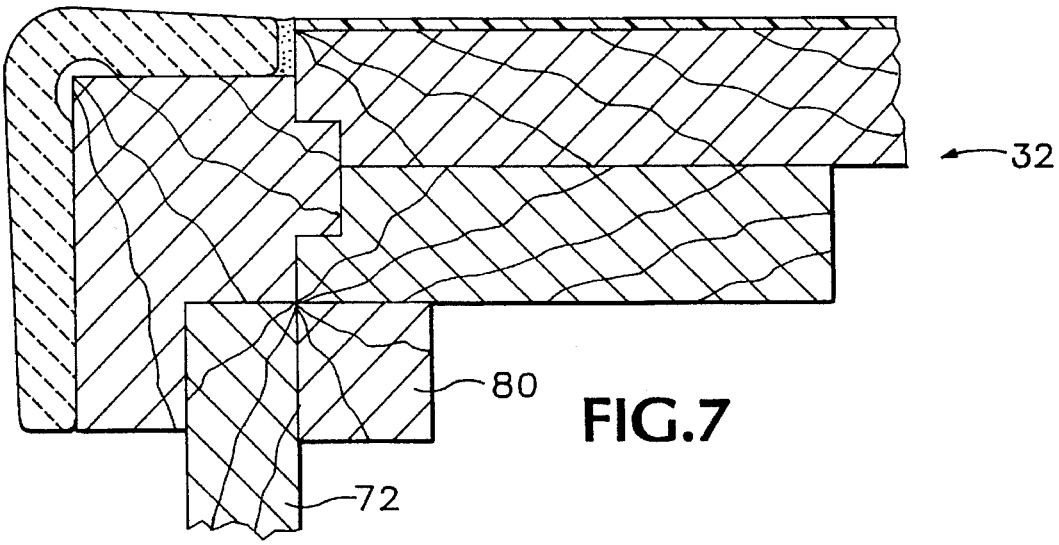
FIG. 7 is the partial section view of the L-shaped molding shown in FIG. 6 with an additional support member.

Referring to FIG. 7, a support member 80 extends underneath the edge of top member 32 and along the top edge of the side wall 72. The support member 80 provides additional support for the top member 32.

Figure 8:
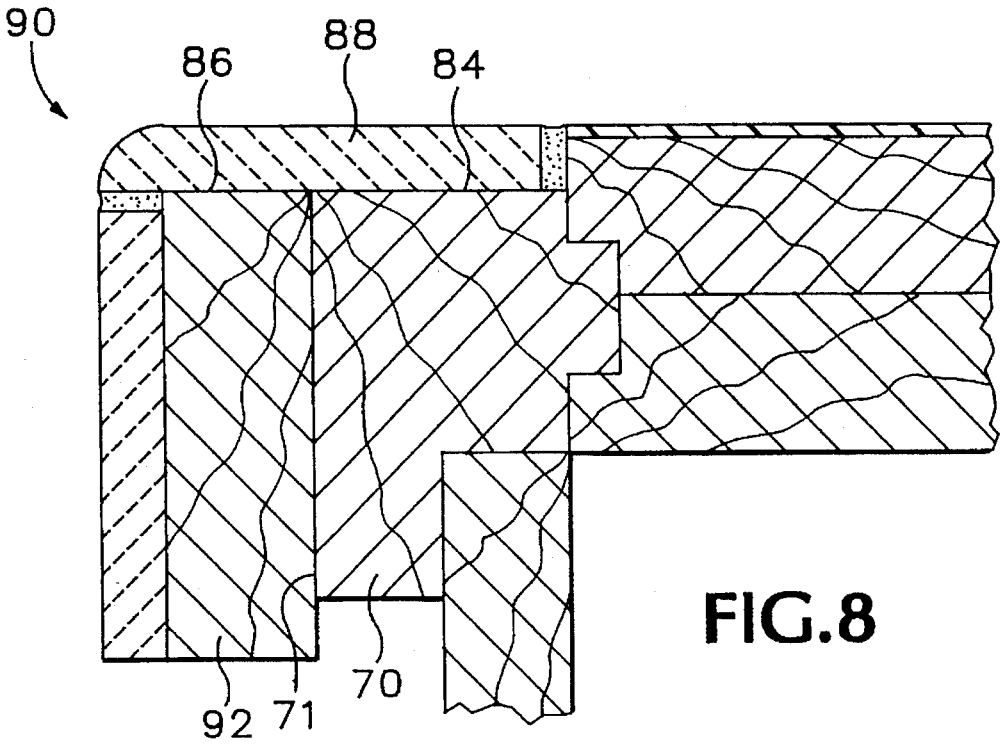
FIG. 8 is the partial section view of the L-shaped molding shown in FIG. 6 having an additional extension member.

Referring to FIG. 8, an extension member 92 is joined to the outside face 71 of molding 70. A top face 84 of the molding 70 in combination with a top face 86 of the extension member 92 have substantially the same length as the top portion of an edge member 90. The extension member 92 allows different sized tiles to be placed on the top and against the sides of a single standard sized molding 70. The extension member 92 is typically glued and then drilled onto the outside face of molding 70.

The countertop 12 is typically installed in the following manner. The sheet material 14 is glued to the top surface of the top member 32. According to the type of base structure, the top member may be supported above the ground by the side walls 72 (FIG. 6) or may be temporarily supported above the ground, for example, with a sawhorse, until the molding 70 are attached around the edge.

A router bit is preset at the necessary distance to cut the groove 38 into the edge of the top member 32. The moldings 28 are precut and pre-drilled. The installer then simply snaps and glues the tongue portions 40 into the grooves in the side of top member 32. The screws 30 are then inserted though the pre-drilled holes and drilled into the side of top member 32 until the screw head 35 is flush with the outside face 31 of molding 28.

The edge members 16 are then placed over the top face 29 and along the side face 31 of an associated molding 28. The edge tiles are placed adjacent to each other around the front edge of the top member 32. The edge tiles are glued to the molding and grouted at the side and front edges so that the sheet material and edge members form a cohesive water impervious covering over the top member 32 and along the side walls 72.

Because a variety of different tile shapes and colors can be utilized in the countertop 12, a countertop designer has greater flexibility in meeting a wider variety of different visual requirements. The molding is quick and easy to assemble so that a novice can install the complete countertop system without having to use special equipment.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A modular countertop, comprising:

a base structure having a fixed top member with a front edge;

a flat sheet material having a top surface and a front edge aligned with the front edge of the top member, the sheet material attached to the top member of the base structure and formed of a first material which is essentially impervious to moisture penetration, impact and scratching;

supporting means for connecting to the base structure having a horizontally aligned top face and a vertically aligned side face;

multiple unitary preformed substantially "V-shaped" edge members connected to the supporting means and formed of a second material, each edge member including a horizontal top portion extending over the top face of the supporting means having a front face aligned with the front edges of the top member and the sheet material and a vertical side portion extending over the entire side face of the supporting means; and sealing means for sealing between the side faces of adjacent edge members and between the front face of each edge member and the front edge of the sheet material thereby forming a cohesive water impervious covering over the top member and around the front edge of said top member.

2. A modular countertop according to claim 1 wherein the supporting means comprise a molding having an inside surface joined to the front edge of the top member of the base structure.

3. A modular countertop according to claim 2 wherein the base structure includes a vertical wall having an inside and outside surface, the front edge of the top member of the base structure recessed behind the outside surface of the vertical wall.

4. A modular countertop according to claim 2 wherein the molding includes pre-drilled screw holes extending horizontally through the molding for receiving and aligning screws that extend through the molding into the front edge of the top member.

5. A modular countertop according to claim 2 wherein the top face of the molding is recessed below the top surface of the sheet material a distance substantially equal to a thickness of the top portion of the edge members, a top surface of the top portion of the edge member thereby mounted substantially flush with the top surface of the sheet material.

6. A modular countertop comprising: a base structure having a fixed top member with a front edge: a flat sheet material having a top surface and a front edge aligned with the front edge of the top member the sheet material attached to the top member of the base structure and formed of a first material which is essentially impervious to moisture penetration, impact and scratching;

supporting means for connecting to the base structure, the supporting means comprising a molding having a horizontally aligned top face, a vertically aligned outside face and an inside surface joined to the front edge of the top member of the base structure;

the top face of the molding being recessed below the top surface of the sheet material a distance substantially equal to a thickness of the top portion of the edge members, a top surface of the top portion of the edge member thereby mounted substantially flush with the top surface of the sheet material;

multiple preformed substantially "V-shaped" edge members connected to the supporting means and formed of a second material, each edge member including a top portion having a front face aligned with the front edges of the top member and the sheet material, a front portion and side faces; and sealing means for sealing between the side faces of adjacent edge members and between the front face of each edge member and the front edge of the sheet material thereby forming a cohesive water impervious coveting over the top member and around the front edge of said top member; and the base structure including a sidewall and the inside surface of the molding including an L-shaped notch located over a top face and against an outside face of the side wall.

7. A modular countertop comprising: a base structure having a fixed top member with a front edge: a flat sheet material having a top surface and a front edge aligned with the front edge of the top member, the sheet material attached to the top member of the base structure and formed of a first material which is essentially impervious to moisture penetration, impact and scratching;

supporting means for connecting to the base structure, the supporting means comprising a molding having a horizontally aligned top face, a vertically aligned outside face and an inside surface joined to the front edge of the top member of the base structure;

the top face of the molding being recessed below the top surface of the sheet material a distance substantially equal to a thickness of the top portion of the edge members, a top surface of the top portion of the edge member thereby mounted substantially flush with the top surface of the sheet material;

multiple preformed substantially "V-shaped" edge members connected to the supporting means and formed of a second material, each edge member including a top portion having a front face aligned with the front edges of the top member and the sheet material, a front portion and side faces;

sealing means for sealing between the side faces of adjacent edge members and between the front face of each edge member and the front edge of the sheet material thereby forming a cohesive water impervious covering over the top member and around the front edge of said top member; and an extension member joined to the outside face of an adjacent molding member, the top face of the molding member in combination with a top face of the extension member having a length substantially equal to the top portion of each edge member.

8. A modular countertop according to claim 1 wherein the edge members comprise a V-shaped ceramic tile.

9. A modular countertop according to claim 1 wherein the top portion of each edge member comprises a first section of ceramic tile and the front portion of the edge member comprises a second separate section of ceramic tile.

10. A modular countertop according to claim 1 wherein the base structure includes a sidewall having an inside surface, an outside surface and a top edge and including a support member with a top surface, the support member positioned underneath the top member of the base structure along the inside surface of the sidewall, the top surface of the support member flush with the top edge of the sidewall.

11. A modular countertop according to claim 1 wherein the sheet material comprises a FORMICA material extending over substantially the entire top surface of the top member.

12. A counter, comprising: sidewalls having a front surface, a back surface and a top edge;

a countertop having a top surface and a front edge recessed in back of the front surface of the side walls;

a flat sheet material extending substantially over the entire top surface of the countertop, the sheet material essentially impervious to moisture penetration, impact and scratching;

multiple modular sections of molding each having a top face, an outside face, an inside surface, and opposite lateral sides, the molding sections joined adjacent to each resting both over the top edge of the side walls and against the front edge of the countertop with the top face of each molding recessed a given distance below the top surface of the countertop; and multiple preformed substantially "V-shaped" edge tiles each including a top portion joined onto the top face of an associated molding and aligned with the front edge of the countertop and a front portion extending against the outside surface of said associated molding, the sheet material and the edge tiles thereby forming a cohesive water impervious covering over the top surface and around the front edge of the base structure.

13. A countertop according to claim 12 wherein the top portion of each edge tile slopes downward from the front portion down to an edge of the sheet material.

14. A counter according to claim 12 wherein each tile slidingly attaches onto the molding completely coveting the entire top face and entire outside face of said molding.

15. A counter according to claim 12 including multiple support members extending along the back surface of the side walls, the support members each having a top edge flush with the top edge of the side walls.

16. A counter according to claim 15 wherein the countertop is supported above the top edge and behind the back surface of the side walls by the support members.

* * * * *